United States Patent [19]

Leliaert

[11] 3,979,073

[45] Sept. 7, 1976

[54] METHOD AND APPARATUS FOR CONDITIONING GRANULAR MATERIAL

[75] Inventor: Raymond M. Leliaert, South Bend, Ind.

[73] Assignee: Wheelabrator-Frye, Inc., Mishawaka, Ind.

[22] Filed: Apr. 3, 1975

[21] Appl. No.: 564,860

[52] U.S. Cl. ..... 241/5; 241/14; 241/40; 241/91; 241/DIG. 10

[51] Int. Cl.[2] ..... B02C 19/06

[58] Field of Search ..... 241/5, 14, 26, 29, 40, 241/43, 91, 152 A, 275, DIG. 10; 51/9 R

[56] References Cited

UNITED STATES PATENTS

| | | | |
|---|---|---|---|
| 2,103,374 | 12/1937 | Nikan | 241/91 |
| 2,211,570 | 8/1940 | Kennedy et al. | 241/91 |
| 2,246,902 | 6/1941 | Smith | 241/91 |
| 3,694,963 | 10/1972 | Leliart | 51/9 |
| 3,768,209 | 10/1973 | Punter et al. | 51/9 |
| 3,782,643 | 1/1974 | Carpenter | 241/60 |

*Primary Examiner*—Granville Y. Custer, Jr.
*Attorney, Agent, or Firm*—McDougall, Hersh & Scott

[57] ABSTRACT

A method and apparatus for scrubbing particles of sand used in foundry molding is disclosed. The device utilizes a rotating impellor surrounded by a stationary control cage having at least one upwardly positioned opening therein to project sand against a target. The sand rebounds from the target and is continually intercepted and impacted by subsequent grains of sand hurled by the impellor through the control cage opening. The device produces a scrubbing action on the particles by the repeated and continual contact with each to reduce binder buildup from the molding process. A first stage scrubbing of the particles is obtained by causing the particles to be compacted between the rotating impellor and the control cage prior to their being thrown against the target. The sand particles may be recycled through the device any number of times in order to increase the scrubbing effect and further reduce binder buildup.

16 Claims, 9 Drawing Figures

METHOD AND APPARATUS FOR CONDITIONING GRANULAR MATERIAL

BACKGROUND OF THE INVENTION

This invention relates to the field of foundry molding techniques. More particularly, it relates to the field of devices for reclaiming sand or similar granular material used in foundry molding. Reclamation of molding sand is highly desirable in view of the significant cost and high quality of the sand necessary for this purpose. By reclaiming this sand, significant reductions in cost and conservation of resources are obtained. To reclaim the sand it is necessary that it be reduced from lumps to single discrete grains and that trash, metallic particles and the like be removed therefrom. An additional treatment which must be performed on the sand grains is removal of the residual binder utilized in the molding process. Often these binders are organic resins or dead clay in the case of green sand in a clay bonding system.

Failure to remove sufficient amounts of the binder results in molds of insufficient strength if only reclaimed sand is utilized, or alternatively, it is necessary to continually add new sand to the reclaimed sand in order to obtain high strength molds if the binder is not adequately reduced.

It will be appreciated that one cubic foot of sand contains on the order of four hundred million sand grains and that it is therefore no simple task to obtain sufficient interfacial contact between the sand grains to produce a scrubbing action. According to the present invention, such interfacial scrubbing is obtained.

In the prior art, it has been known to provide devices for conditioning granular material, for example, U.S. Pat. No. 3,782,643 to Carpenter. In this device a centrifugal throwing wheel projects material horizontally outwardly therefrom for impact against a surface. The material rebounds from the surface downwardly to a collection trough. The Carpenter device does not produce a high density interfacial contact along the sand grains to reduce binder buildup due to the divergent paths of the sand grains. The grains once thrown outwardly by the wheel pass only briefly through the blast pattern before they fall to the collection trough.

It is accordingly an object of the present invention to provide an improved scrubbing method and apparatus for sand and similar granular material which greatly enhances the number of interparticle reactions to increase the effective removal of binder thereon.

It is another object of the present invention to provide a scrubbing method and apparatus for granular material in which the granular material returns along substantially the same path as it is dispensed to maximize interparticle reactions.

It is a further object of the present invention to provide a device which effects a two-stage scrubbing of granular material by movement of material between an impellor and control cage of the device prior to its being thrown from the impellor.

Other objects and advantages of the invention will become apparent from the remaining portions of the specification.

DETAILED DESCRIPTION

The granular conditioning system according to the present invention effects a two-stage scrubbing or conditioning upon the granular material processed therethrough. In addition, according to a second embodiment of the invention, the granular material may be recycled through the system as many times as necessary to effect a desired degree of binder removal. As is well known in the art, organic binder buildup or granular materials, particularly molding sand, causes a loss or ignition (LOI) which can result in lower mold strength and unsatisfactory molding results. According to the present invention, a first stage of sand conditioning is accomplished by passing the sand from a supply hopper to the interior of a rotating impellor which is surrounded by a control cage having at least one upwardly disposed opening. The sand passes through the rotating impellor which has a plurality of openings therethrough to the space between the impellor and the control cage where it receives a first stage conditioning by being compressed against other sand grains in the confined space and rubbed against the sides of the confining structure.

The second stage of sand conditioning is accomplished by the operation of the impellor which is effective for throwing sand upwardly through the control cage opening into a housing having a target formed at the top and sides thereof. The sand strikes the target and rebounds therefrom along substantially the same path. Thus, as the sand rebounds from the target, it falls downwardly by force of gravity through a continuous shower of upwardly projecting sand particles which results in numerous collisions between the particles producing the desired conditioning or scrubbing.

Figure 1:
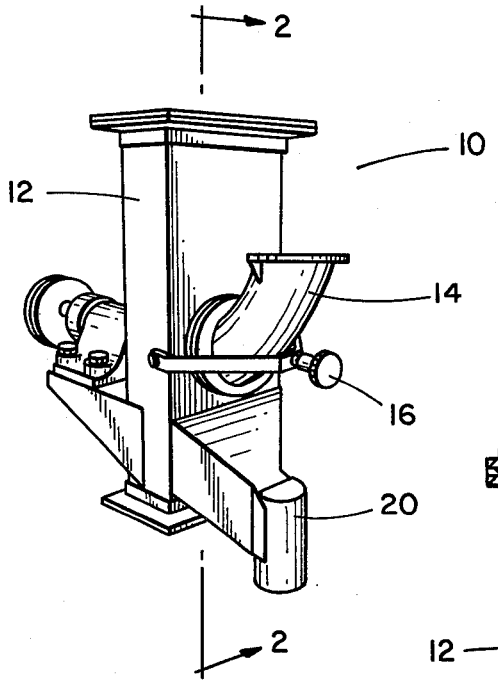
FIG. 1 is a perspective view of the device according to a first embodiment of the invention.

Referring now to FIG. 1, the device according to a first embodiment of the invention is illustrated. The two-stage scrubber 10 has a housing 12 to which a feed spout 14 is removably attached for receiving sand or other granular material to be conditioned. The feed spout 14 is secured in position over an opening in the housing by a release mechanism 16. Mounted in the housing 12 are targets 18 and 19 which are secured thereto. Sand which has completed the treatment is discharged from the device through a discharge chute 20.

Figure 2:
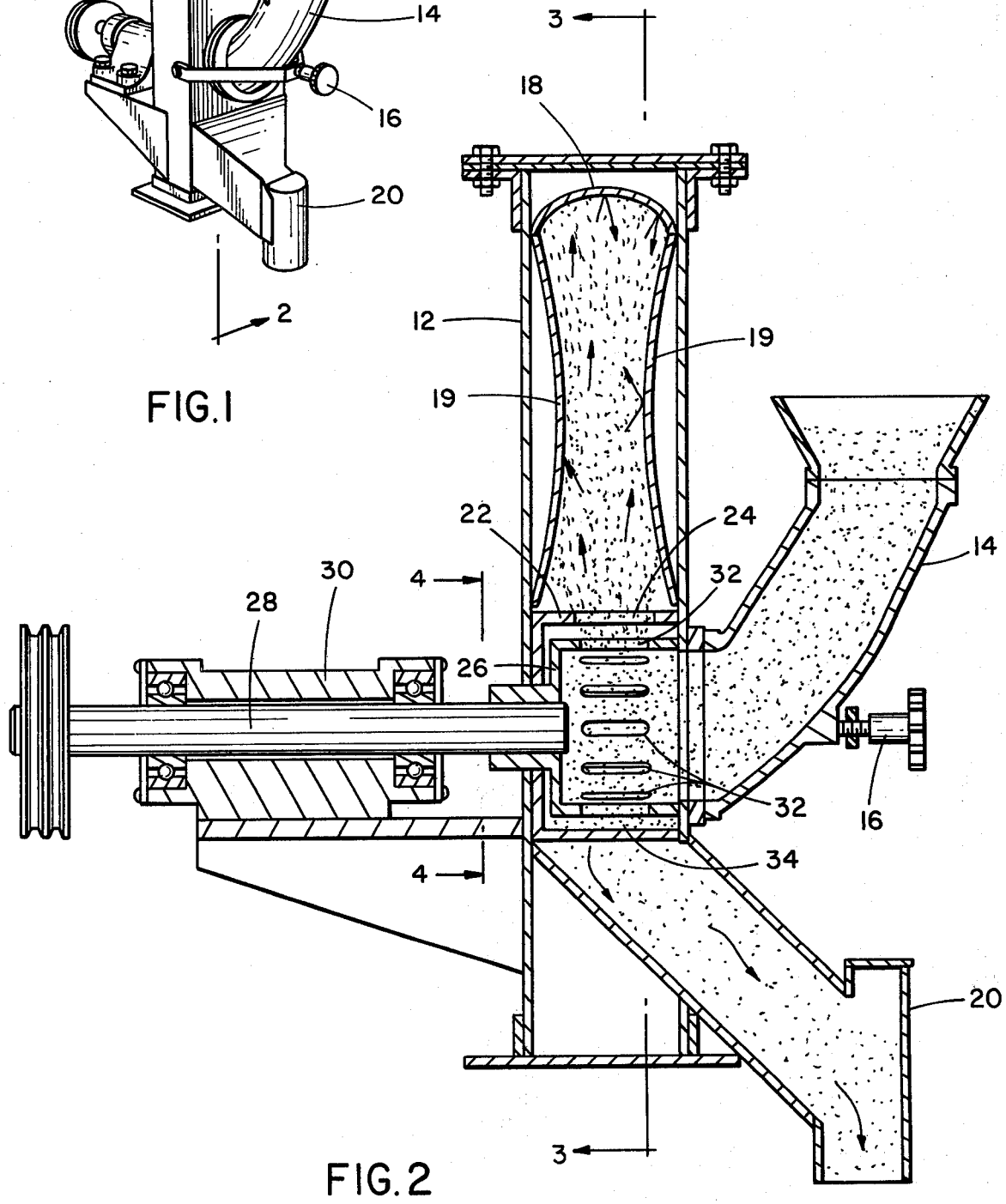
FIG. 2 is a sectional view through the device illustrating the details thereof taken along the lines 2—2 of FIG. 1.
Figure 4:
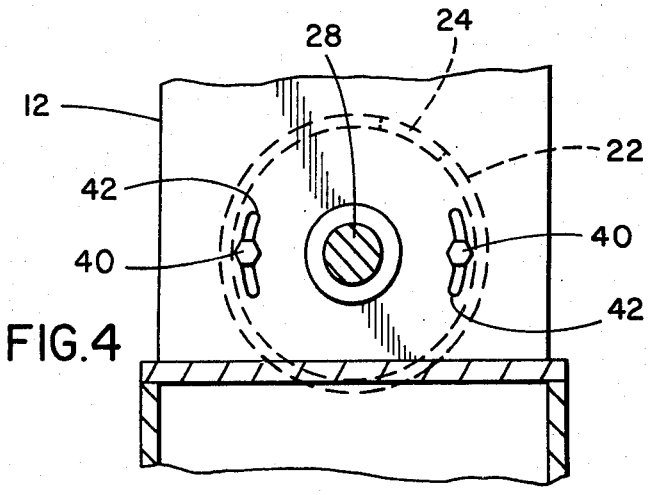
FIG. 4 is a view illustrating the manner of adjusting the control cage position.

Referring to FIG. 2, the details of the device are illustrated. Provided in the housing 12 is a control cage 22 cylindrical in cross section and having a single opening 24 at a top portion thereof. As illustrated in FIG. 4, the control cage is adjustable within the housing for positioning the opening 24 as necessary to obtain optimal operating conditions.

Located within the control cage 22 is an impellor 26 attached to a direct drive shaft 28 for rotation therewith. Shaft 28 is preferably provided in a shaft bearing 30 and in the usual manner is connnected to a motor for rotation. The impellor 26 has a plurality of equally spaced openings 32 provided through its cylindrical wall and, like the control cage, has a hollow interior. The wall diameter of the impellor is chosen such that there is no contact between the impellor and the control cage during rotation of the former and further, that an annular space 34 is provided therebetween.

When sand is received from the feed spout 14 into the interior of the impellor 26, it drops downwardly through the openings 32 into the annular space 34 between the impellor, and the control cage. Due to the rotation of the impellor, the sand is compacted against the walls of the control cage and impellor which effectively scrubs the particles to effect a first stage of conditioning.

In a somewhat random manner, the particles, after being subjected to this first stage of conditioning, are thrown by the impellor 26 through the opening 24 in the control cage 22. The opening 24 is positioned upwardly, and as will be described, is positioned to produce a substantially vertical stream of particles directed at the target 18. Due to the high rotational velocity of the impellor, the particles strike the target 18 with considerable energy. Striking the target effects a further conditioning of the sand and has been found to be moderately effective in contributing towards the total efficiency of the system.

After striking target 18 and to a less extent targets 19, the sand particles rebound therefrom along substantially the same path. As will be apparent, therefore, a large number of interparticle collisions are produced as the upward stream of particles strikes the rebounding particles. Thus, as the sand grains rebound and pass downwardly in the housing 12, they are struck many thousands of times by the upwardly directed stream from the impellor 26.

These interparticle reactions caused by having the rebounding particles pass back through the shower of upwardly directed particles constitute a second stage of conditioning and produce a quite effective reduction in binder coating on the particles.

Figure 3:
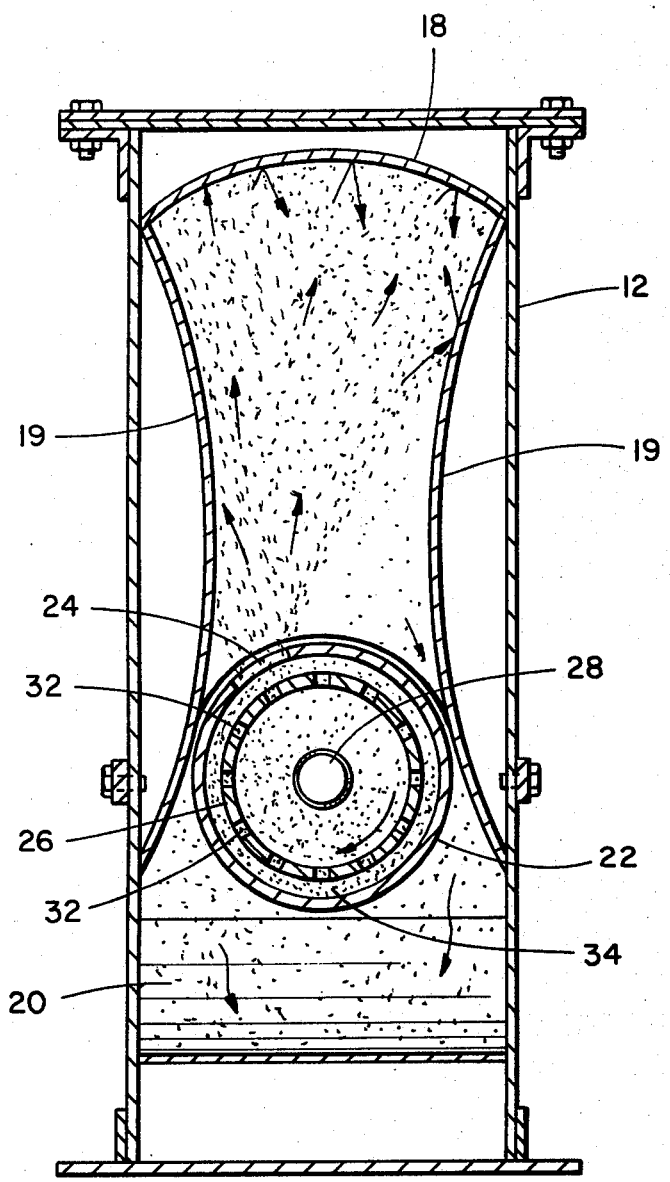
FIG. 3 is a view along the lines 3—3 of FIG. 2.

Referring to FIG. 3, it will be seen that as the particles rebound, they reach a point where they are at or below the level of the control cage and thus are finally out of the bombarding stream of upwardly projected particles. At this point, by force of gravity, they drop downwardly, on either side of the control cage into the discharge chute 20.

Referring now to FIG. 4, a view illustrating the manner in which the control cage opening 24 can be optimally positioned to insure maximum interparticle reactions is illustrated. As shown, the control cage 22 is secured in place during operation of the device by a pair of bolts 40 which pass through slots 42 in the housing 12. When it is desired to adjust the position of opening 24 it is only necessary to loosen bolts 40 and rotate the control cage in one direction or the other as necessary to optimize performance. The bolts 40 are then resecured to lock the control cage in position during operation of the device.

Figure 5:
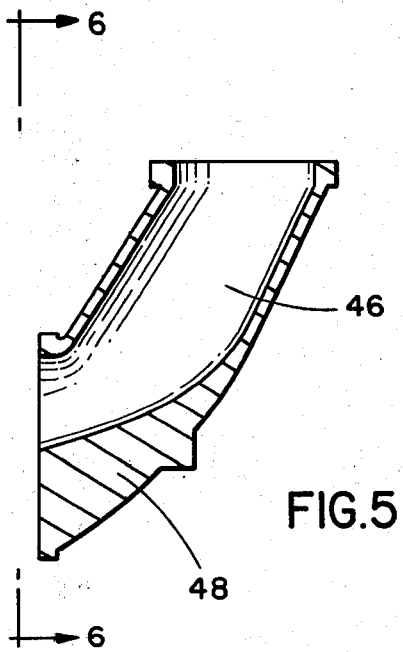
FIG. 5 is a sectional view through a feed spout according to a modification thereof.
Figure 6:
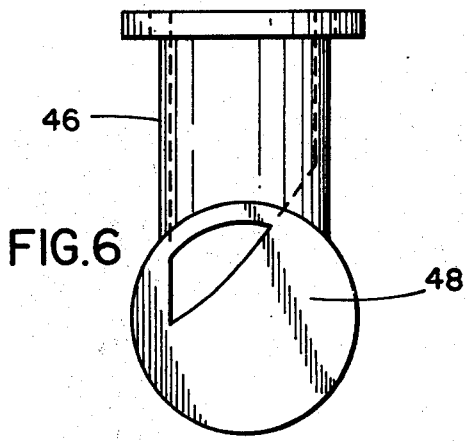
FIG. 6 is an end view of the feed spout of FIG. 5 taken along the lines 6—6.

Referring now to FIG. 5, a modified feed spout 46 is illustrated. This spout is similar to feed spout 14 except that it is restricted at its lower end by a solid portion 48, thereby narrowing its effective diameter. This reduces the flow rate through the feed spout 46 and also controls the location at which incoming material is fed to the rotating impellor. As illustrated best in FIG. 6, the feed spout 46 causes granular material to be inserted into the impellor at an upper portion thereof. This causes sand fed into the impellor to travel a maximum distance in the annular space 34 (between the control cage and impellor) before being thrown through the opening 24 to strike the target 18.

Figure 7:
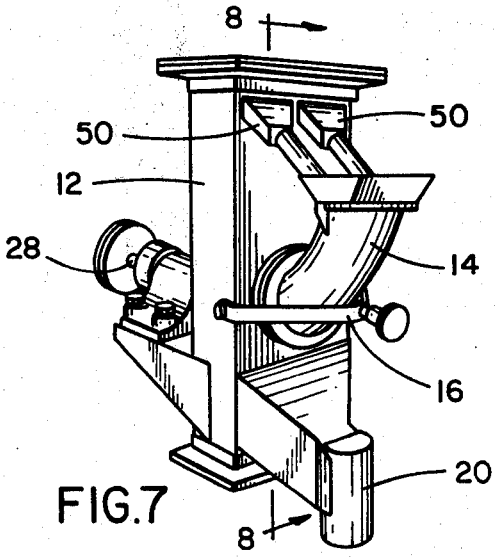
FIG. 7 is a perspective view of a scrubber according to a second embodiment of the invention.
Figure 9:
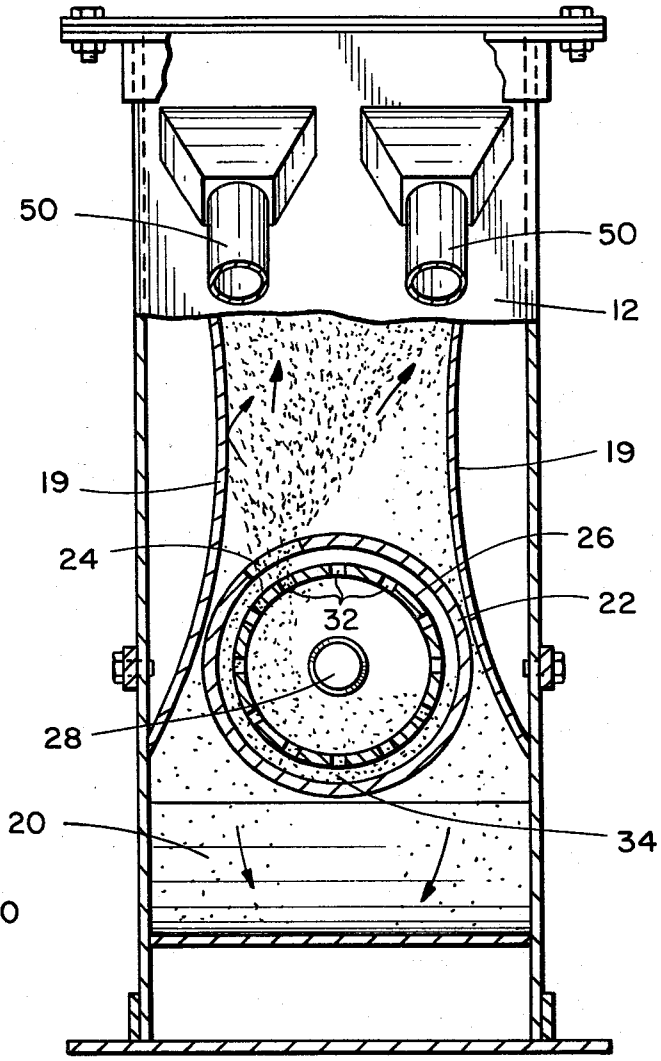
FIG. 9 is a view taken along the lines 9—9 of FIG. 8.
Figure 8:
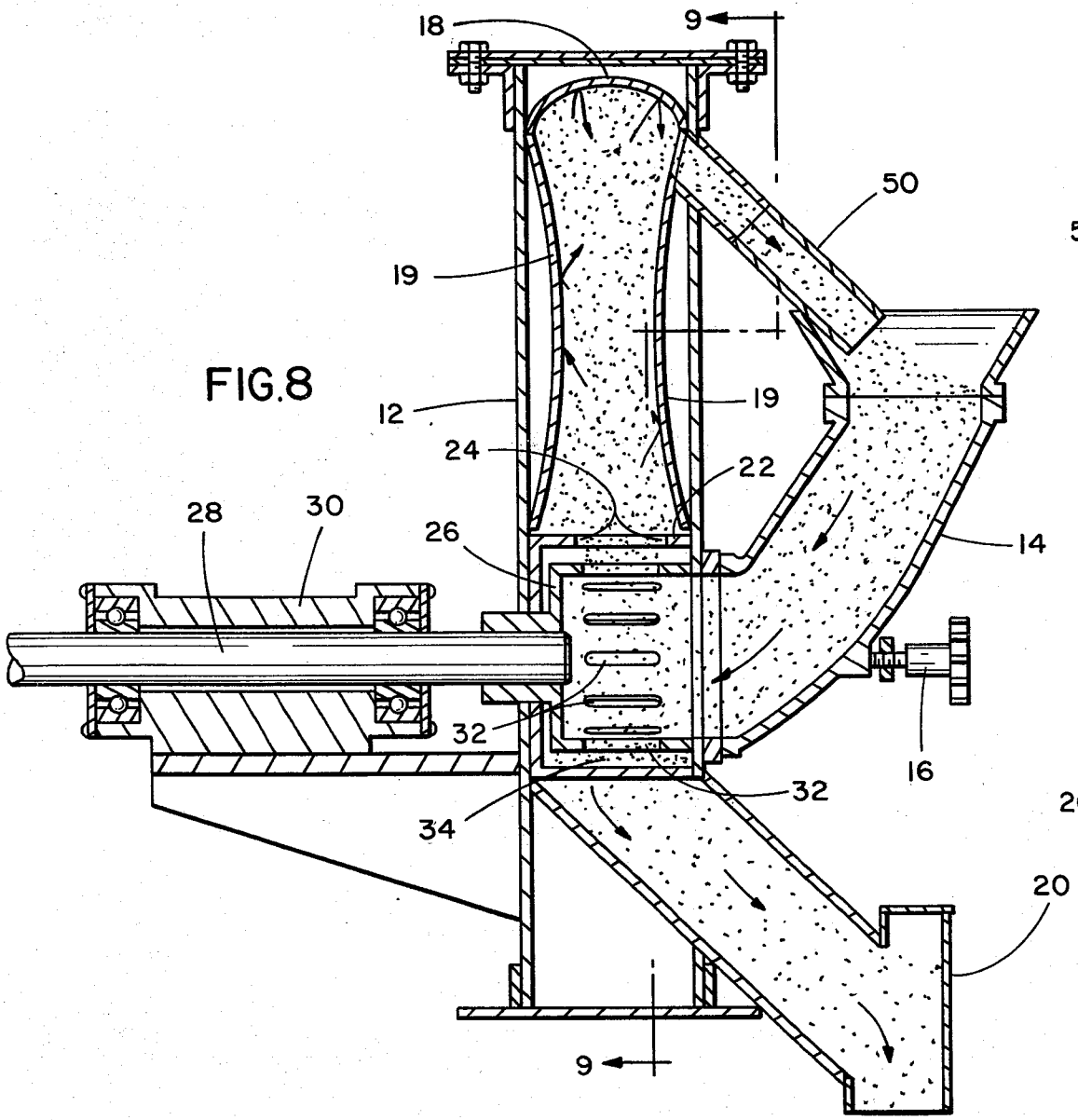
FIG. 8 is a sectional view through the device of FIG. 7 along the lines 8—8.

Referring now to FIGS. 7–9, the device according to a second embodiment is illustrated. For simplicity, those elements common to the first embodiment have been given the same reference numerals in the drawing. The second embodiment is characterized by the provision of means for permitting granular material to be repetitively cycled through the device to enhance the conditioning effect. For this purpose, the housing 12 is modified by providing at least one removable return conduit 50 communicating the interior of the housing near the target 18 with the feed spout 14. Conduit 50 returns a portion of the granular material to feed spout 14 where it is recycled through the device for further conditioning. By controlling the percentage of sand that is recycled, virtually any degree of binder removal desired can be obtained. The percentage of sand recycled is controlled by the positioning of the conduit 50 in the housing 12. Also, if desired, deflector baffles can be used to control the amount of sand which passes into the return conduit (s) 50.

By the arrangement shown in FIGS. 7–9, there is obtained a device which will recycle the granular material provided thereto a sufficient number of times to effect a dramatic reduction in binder buildup on molding sand and the like. It is also contemplated to utilize multiple devices in stages whereby the output of one conditioning device is fed to the spout of the next device and so on.

While I have shown and described embodiments of this invention in some detail, it will be understood that this description and illustrations are offered merely by way of example, and that the invention is to be limited in scope only by the appended claims.

I claim:

1. A device for conditioning granular material to reduce buildup of contaminants on the surface thereof comprising:

a. a housing;

b. a target mounted at the upper end of said housing;

c. means in said housing for continuously projecting said granular material in an upward path at said target with sufficient kinetic energy to strike said target and rebound therefrom downwardly through the continuing upward stream of material; whereby substantial numbers of intergranular collisions are produced to effect a reduction in surface contaminants;

d. means for supplying granular material to the projecting means;

e. means for discharging the conditioned granular material; and f. means for returning a portion of the granular material striking said target to said supply means for further conditioning prior to discharge from said device.

2. A device for conditioning granular material to reduce buildup of contaminants on the surface thereof comprising:

a. a housing;

b. a target mounted at the upper end of said housing;

c. means in said housing for continuously projecting said granular material in an upward path at said target with sufficient kinetic energy to strike said target and rebound therefrom downwardly through the continuing upward stream of material including means for focusing said granular material along said upward path; whereby substantial numbers of intergranular collisions are produced to effect a reduction in surface contaminants;

d. means for supplying granular material to the projecting means; and e. means for discharging the conditioned granular material.

3. The device of claim 1 wherein said target is a plate secured to the upper end of said housing.

4. The device of claim 1 wherein said projecting means include:

impellor means having a plurality of openings therethrough for throwing said material outwardly therefrom through said openings.

5. The device according to claim 4 wherein said impellor means include:

a. a hollow cylindrical impellor having said openings spaced on the circumference of the cylinder; and b. means for rotating said impellor whereby said rotating impellor receives said material from said supply means in the hollow interior thereof and throws said material radially outwardly therefrom through said spaced openings.

6. The device according to claim 2 wherein said focusing means is a cylindrical control cage having one opening on its upper circumference.

7. The device of claim 2 wherein said projecting means include:

a. impellor means having a plurality of openings therethrough for throwing said material outwardly therefrom through said openings;

b. means for focusing said granular material along said upward path.

8. The device according to claim 7 wherein said focusing means is a control cage circumferentially disposed about said impellor means, said control cage having one upwardly directed opening for passage of said material therethrough and defining an annular space between said impellor means and said control cage in which said material is compacted and scrubbed prior to being thrown by said impellor means.

9. The device according to claim 8 wherein said impellor means include: a. a hollow cylindrical impellor having said openings spaced on the circumference of the cylinder; and b. means for rotating said impellor whereby said rotating impellor receives said material from said supply means in the hollow interior thereof and throws said material radially outwardly therefrom through said spaced openings.

10. The device according to claim 9 wherein said supply means is a feed spout which supplies said material to the interior of the hollow impellor whereby said material passes through the impellor openings into said annular space for said scrubbing.

11. The deivce according to claim 10 wherein said feed spout constricts at the end communicating with the impellor interior to cause said material to enter said impellor at a location, relative to the direction of rotation of said impellor, which maximizes the distance the material moves in said annular space prior to being thrown at said target.

12. A two-stage device for conditioning granular material to reduce buildup of contaminants on the surface thereof comprising:

a. a housing;

b. a target mounted at the upper end of said housing;

c. first means in said housing defining an annular space into which said material is compacted for effecting a first stage of conditioning by scrubbing said material against itself and the first means, said first means including projecting means for continuously projecting the first stage conditioned material along an upwardly directed path at said target with sufficient kinetic energy to strike said target and rebound therefrom along substantially the same path causing substantial numbers of intergranular collisions to effect a second stage of conditioning said first means including means for focusing said granular material along said upwardly directed path;

d. second means supplying grranular material to said first means; and e. third means discharging the conditioned material.

13. A method for conditioning granular material to reduce buildup for contaminants on the surface thereof comprising the steps of:

a. supplying granular material to a projecting means;

b. continuously projecting a focused stream of said granular material in an upward path at a target with sufficient kinetic energy to strike said target and rebound therefrom downwardly through the continuing upward stream of material whereby substantial numbers of intergranular collisions are produced to effect a reduction in surface contaminants; and c. discharging the conditioned granular material.

14. A method for conditioning granular material to reduce buildup of contaminants on the surface thereof comprising the steps of:

a. supplying granular material to a projecting means;

b. continuously projecting said granular material in an upward path at a target with sufficient kinetic energy to strike said target and rebound therefrom downwardly through the continuing upward stream of material whereby substantial numbers of intergranular collisions are produced to effect a reduction in surface contaminants;

c. discharging the conditioned granular material; and d. returning a portion of the granular material striking said target to said projecting means for further conditioning prior to discharge.

15. A method for conditioning granular material to reduce buildup of contaminants on the surface thereof comprising the steps of:

a. compacting said material into an annular space for effecting a first stage of conditioning by scrubbing said material against itself and the first means, continuously projecting a focused stream of the first stage conditioned material along an upwardly directed path at a target with sufficient kinetic energy to strike said target and rebound therefrom downwardly through the continuing upward stream of material causing substantial numbers of intergranular collisions to effect a second stage of conditioning;

b. supplying the granular material to said annular space; and c. discharging the conditioned material.

16. The method of claim 15 further including the step of returning a portion of the granular material striking said target to said projecting means for further conditioning prior to discharge.

* * * * *